US006471569B1

(12) United States Patent
Bernhard

(10) Patent No.: US 6,471,569 B1
(45) Date of Patent: Oct. 29, 2002

(54) ROTARY MOWER BLADE GRINDER

(76) Inventor: Stephen Geoffrey Bernhard, 2 Church Walk, Rugby (GB), CV21 3AZ ( * ) Notice: Subject to any disclaimer, the term of this patent is extended or adjusted under 35 U.S.C. 154(b) by 0 days.

(21) Appl. No.: 09/601,675

(22) PCT Filed: Feb. 5, 1999

(86) PCT No.: PCT/GB99/00197

§ 371 (c)(1),
(2), (4) Date: Sep. 15, 2000

(87) PCT Pub. No.: WO99/39868

PCT Pub. Date: Aug. 12, 1999

(30) Foreign Application Priority Data

Feb. 6, 1998 (GB) ..... 9802526

(51) Int. Cl.[7] ..... B24B 3/00

(52) U.S. Cl. ..... 451/224; 451/229; 451/365; 451/392; 76/82.1

(58) Field of Search ..... 451/45, 192, 224, 451/193, 196, 198, 202, 203, 205, 206, 208, 229, 248, 371, 364, 381, 392, 377, 365; 76/82.1

(56) References Cited

U.S. PATENT DOCUMENTS

| | | | | | |
|---|---|---|---|---|---|
| 2,200,025 | A | * | 5/1940 | Jones | 451/381 |
| 4,259,814 | A | * | 4/1981 | Glasser et al. | 451/248 |
| 4,265,146 | A | * | 5/1981 | Horrell | 76/82.1 |
| 4,565,094 | A | * | 1/1986 | Sedgewick | 451/392 |
| 4,736,544 | A | * | 4/1988 | Greenquist | 451/202 |
| 4,936,053 | A | * | 6/1990 | Shanelec | 451/229 |
| 5,218,787 | A | * | 6/1993 | Rice | 451/364 |
| 5,311,703 | A | * | 5/1994 | Ketteringham | 451/193 |

FOREIGN PATENT DOCUMENTS

EP 0286266 10/1988

* cited by examiner

*Primary Examiner*—George Nguyen
(74) *Attorney, Agent, or Firm*—Rider, Bennett, Egan & Arundel, LLP

(57) ABSTRACT

A device for grinding a rotary mower blade (16), the device comprising an adjustable support for receiving a rotary mower blade, means for fixing the blade relative to the support, means for feeding the support and blade both axially and transversely relative to a grinding wheel (4), and for pivoting the support towards and away from the grinding wheel.

18 Claims, 4 Drawing Sheets

ROTARY MOWER BLADE GRINDER

This invention relates to a device for grinding a rotary mower blade. The invention also provides a method of grinding a rotary mower blade.

Rotary mowers operate by having substantially planar blade rotating about its midpoint in a plane substantially parallel with the ground over which the mower is running. The blade is provided with cutting edges which extend from one distal end to the center point of the blade, and from the opposite distal end to the mid-point on the opposite blade edge. A sharp edge must be provided for the grass to be cut efficiently.

The initial grinding of the blade to form the cutting edge, and the subsequent regrinding to restore the cutting edge is often carried out by eye using an angle grinder. Clearly, this often leads to an uneven cutting edge, and is time consuming to carry out.

U.S. Pat. No. 5,218,787 to Rice discloses apparatus to be used in conjunction with a bench grinder for use in sharpening mower blades. The apparatus has conventional over-centre gripping pliers mounted on an adjustable carriage to hold the blade.

The present invention seeks to provide an efficient and easily adjustable means for grinding rotary mower blades advantageous over the prior art in that it provides a more accurate and a consistent grind along the whole length of the blade thus minimising the need for subsequent balancing. The invention can also grind the cutting edge of blades at an angle from the longitudinal axis of the blade more quickly and more safely than prior art grinding devices, as it can be operated entirely hands free.

One aspect of he present invention provides a device for grinding a rotary mower blade which device comprises an adjustable support for receiving a rotary mower blade, means for fixing the blade relative to the support, means for feeding the support and blade both axially and transversely relative to a grinding wheel and for pivoting the support towards and away from the grinding wheal, wherein the fixing means is adapted to secure the blade in a first grinding position for grinding one edge of the blade, but in use enables the blade to be released from the first grinding position, turned about a substantially central point of the blade and re-secured in a second grinding position so as to grind the opposite edge of the blade.

According to one optional feature of the invention, the adjustable support comprises a fixed element and a slidable element. Preferably, the sliding element includes a longitudinal slot and the fixed element includes locking means slidable along said slot to adjust the support to a selected overall length.

In another optional feature of this aspect of the present invention the fixing means comprises a cone secured to the slidable element and a magnet secured to the fixed element wherein the cone locates in an aperture in the centre of the blade. Preferably, the magnet is an electromagnet.

A further optional feature provides that the adjustable support is mounted on a carriage for axial and transverse feeding. Preferably, the carriage is mounted on a slide extending perpendicular to the axis of the grindstone for transverse feed. Even more preferably, the transverse feed is controlled by means of a hand wheel attached by a feed screw to said carriage.

A yet further optional feature provides that the carriage is mounted on a slide extending parallel to the axis of the grindstone for axial feed. Optionally, the axial feed may be manually operated.

Alternatively, the axial feed may be automatically operated.

According to another optional feature the support pivots about an axis perpendicular to the axial and transverse feed directions. Preferably, the support pivots about and axis in line with the centre of the magnet mounted on said support.

Optionally, the support may pivot about a selected one of a plurality of available positions on the carriage.

Optionally, the angle of pivot may be set by an adjustable and reversible side stop.

A yet further optional feature provides that the carriage may be fitted with adjustable limit stops for both axial and transverse feed directions.

Another optional feature provides that an additional grindstone attached to an additional motor may be provided such that both sides of blade may be ground simultaneously. Preferably, the or each grindstone is adjustable in height relative to the support.

A second aspect of the present invention comprises a method of grinding a rotary mower blade comprising securing the blade to an adjustable support, adjusting a side stop to set the grinding angle of the blade, setting the transverse feed position using a band wheel, setting the height of a grinding stone relative to the blade, axially feeding the blade past the grindstone until the grinding of one side is complete, releasing the blade from the adjustable support, rotating the blade through substantially 180°, resecuring the blade to the adjustable support, and grinding the opposite side of the blade.

An embodiment of the invention will now be described, by way of example, with reference to the accompanying drawings, in which.

Figure 3:
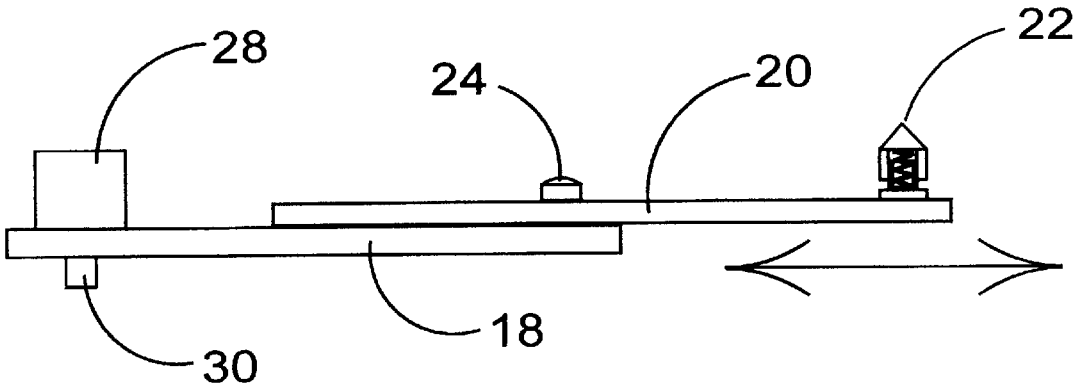
FIG. 3 is a schematic side view of the blade mounting arrangement.
Figure 4:
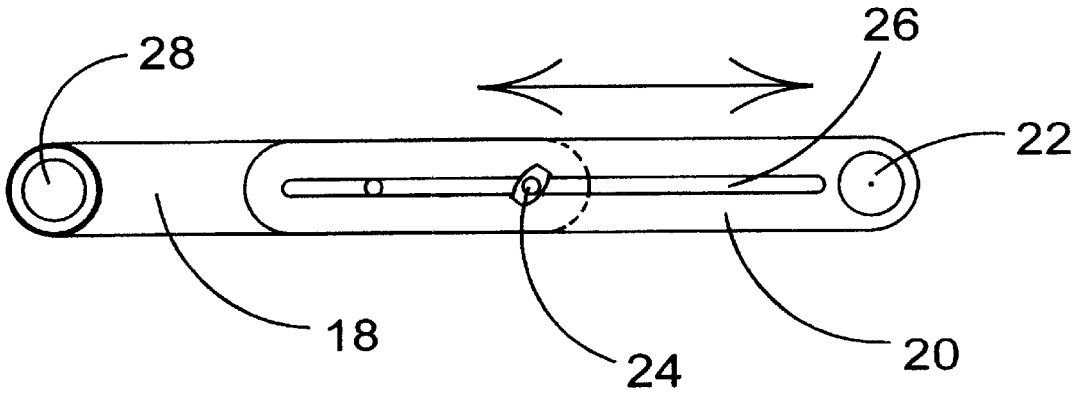
Figure 4A:
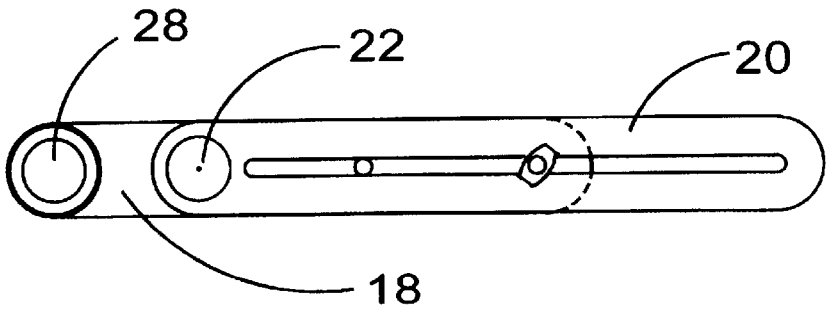
Figure 5:
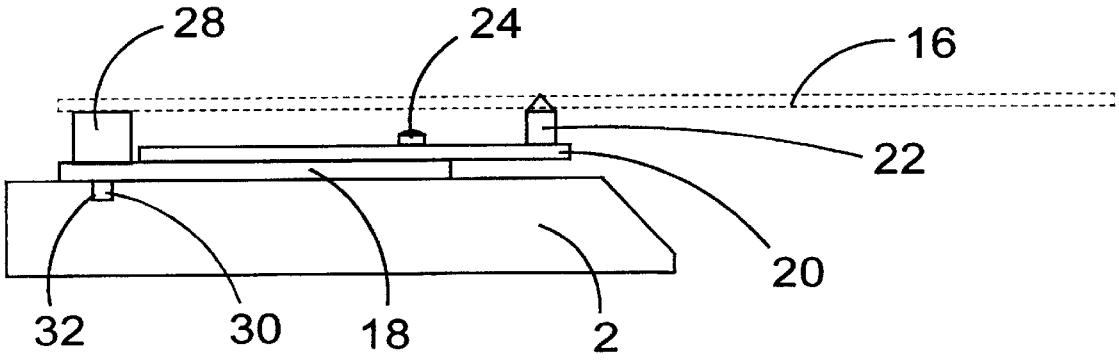
Figure 6:
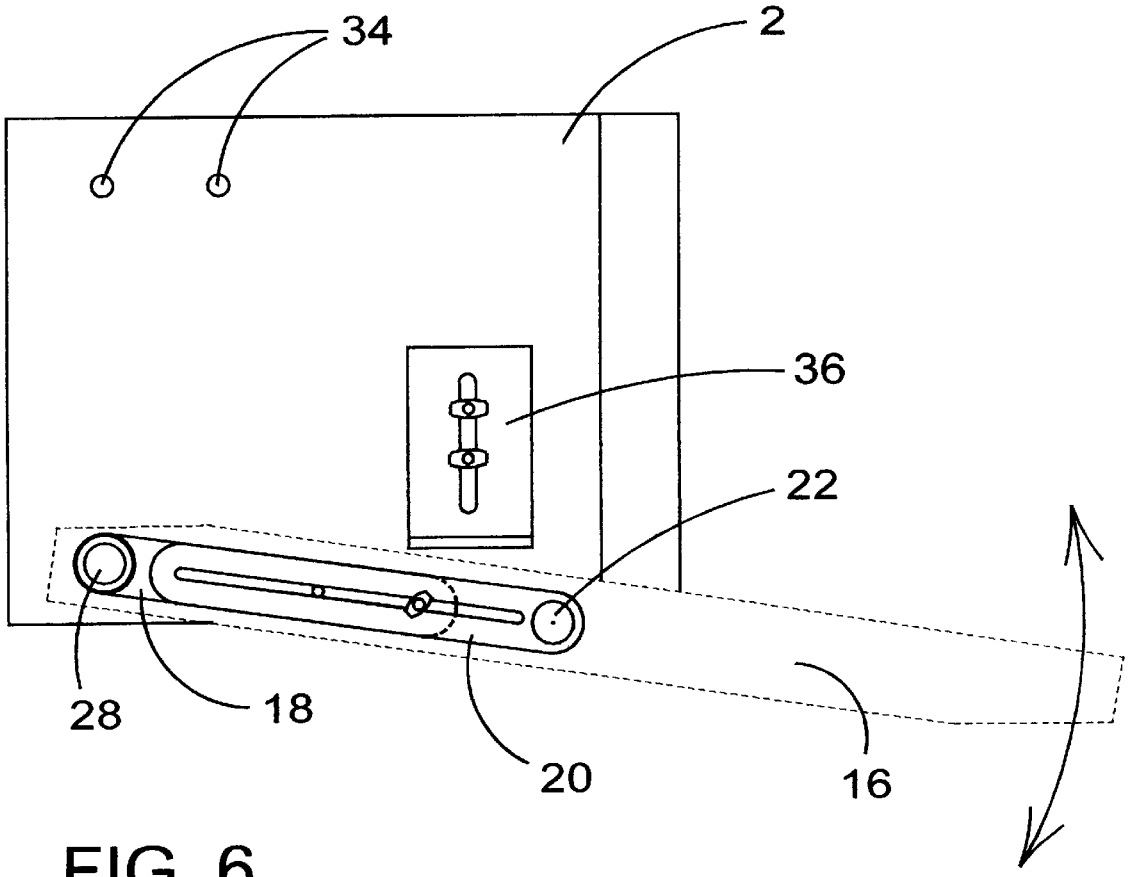

FIGS. 4 and 4*a* are plan views of the FIG. 3 arrangement;

FIG. 5 is a side view of the blade and carriage assembly;

FIG. 6 is a plan view of the blade and carriage assembly; and

Figure 7:
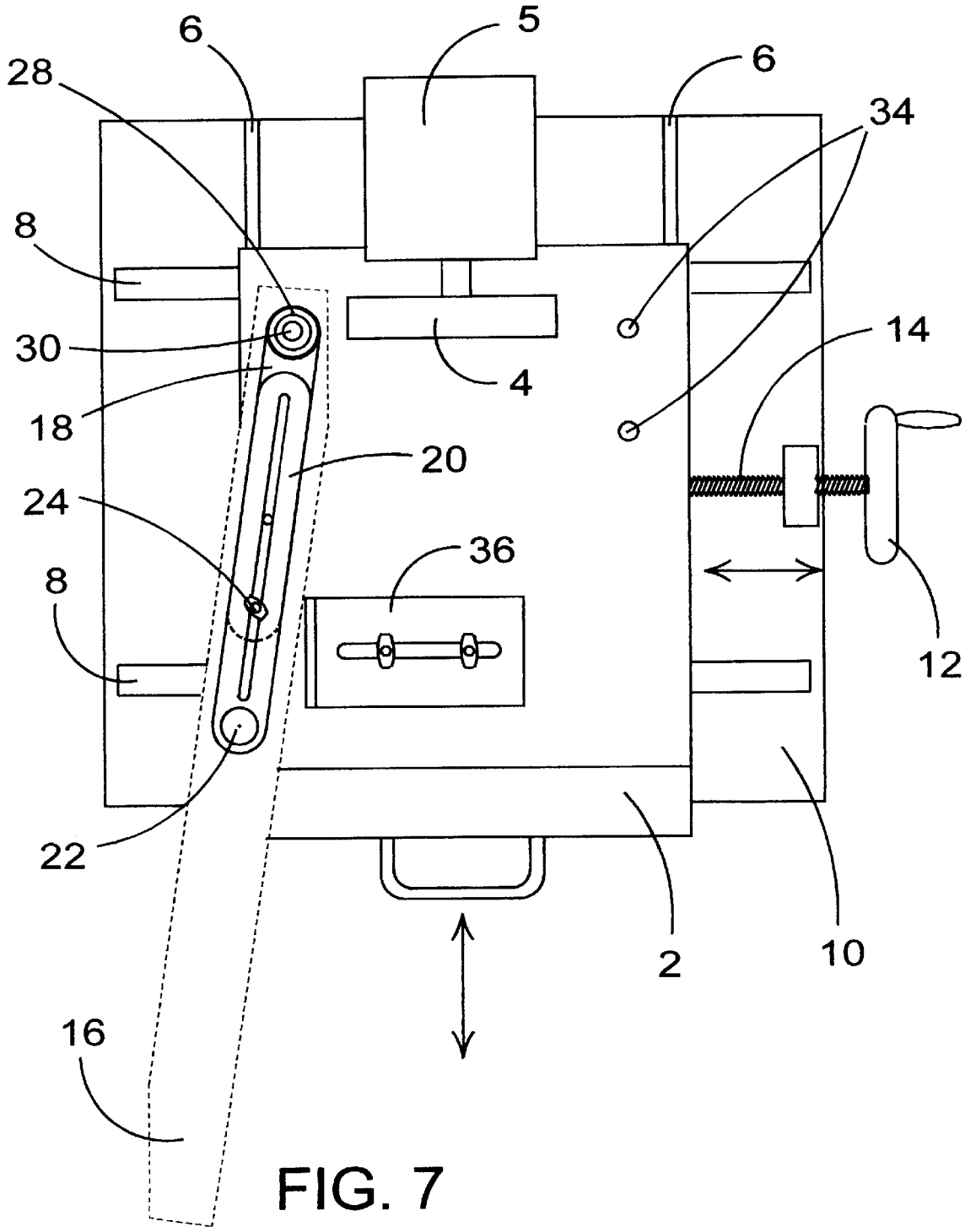

FIG. 7 is a plan view of the whole device.

Referring to the drawings the device comprises an adjustable support for receiving a rotary mower blade 16, means for fixing the blade 16 relative to the support, means for feeding the support and blade both axially and transversely relative to a grinding wheel 4 and for pivoting the support towards and away from the grinding wheel 4.

Figure 1:
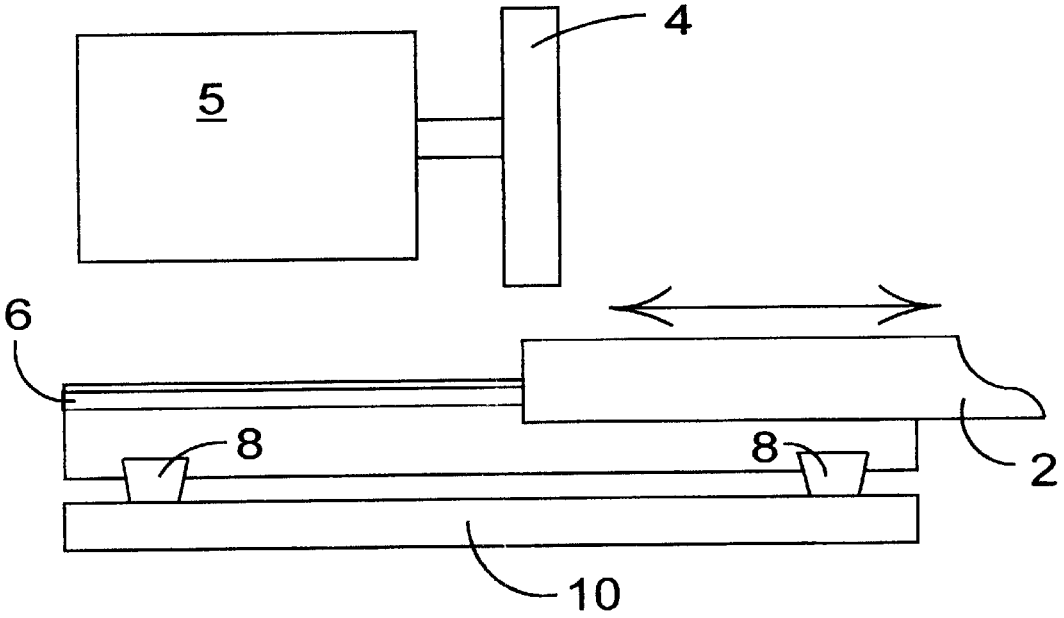
FIG. 1 is a schematic side view of the device.
Figure 2:
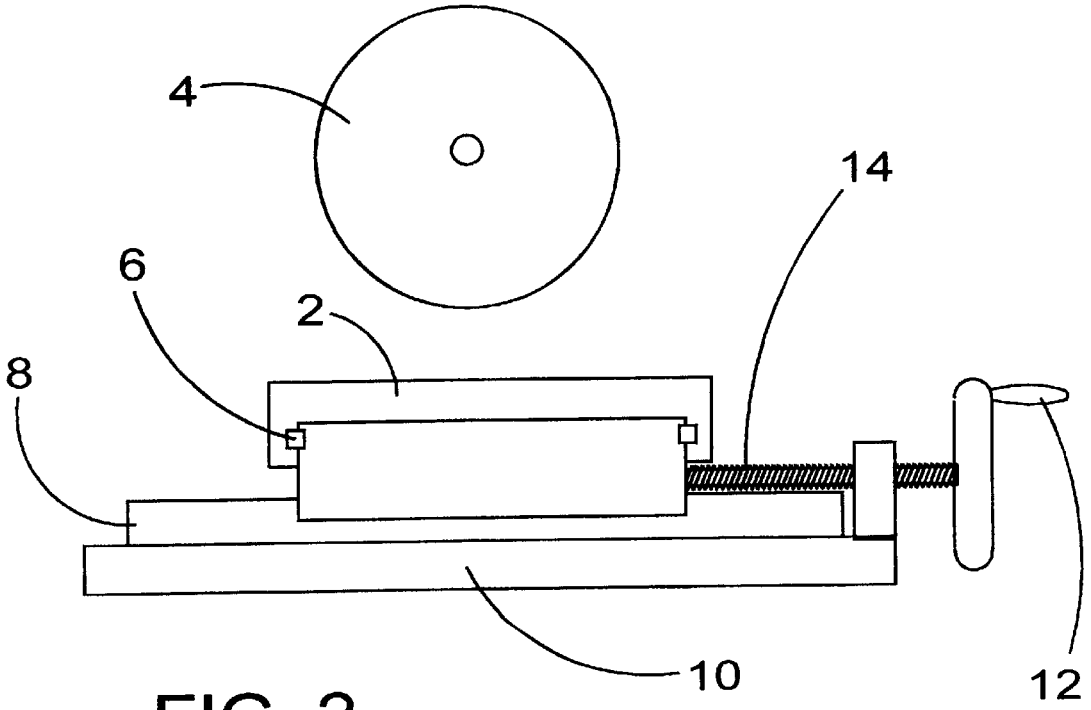
FIG. 2 is a schematic end elevation of the device.

Referring now to FIGS. 1, 2 and 7, the device comprises a carriage 2 movable parallel to the axis of grindstone 4 on slide 6 and transverse the grindstone axis on cross slide 8. The carriage 2 is mounted on platform 10 via slide 6 and cross slide 8. The transverse position of the carriage may be accurately controlled by a hand wheel 12 connected to the carriage by a feed screw 14 although any suitable position controlling means, such as a motor or hydraulic ram may be provided.

Grindstone 4 is powered by a motor 5 which is adjustable up and down to account for wear of the grindstone 4, and to set the appropriate angle of cut to the blade 16. The motor 5 may be of any suitable type, for example electric, internal combustion, hydraulic, or compressed air powered.

Referring now to FIGS. 3 to 6, there is provided an adjustable support for receiving rotary mower blade 16. The support may be telescopic or provide some suitable arrangement for mounting a blade engagement element in any one of a number of suitable positions. However, in the preferred embodiment, the support comprises a fixed element 18 and sliding element 20. The sliding element 20 is mounted on the fixed element and facilitates adjustment of the engagement element according to blade size. The blade engagement element is in the preferred embodiment a springloaded cone 22 which locates the centre hole of the blade 16 on the sliding element 20 however other suitable blade engagement members such as bolts, electromagnets, or cramps are envisaged. A locking member 24 slidable within a slot 26 on the siding element 20 prevents accidental adjustment of the support. The sliding element 20 is reversible to accommodate smaller blade sizes. Suitable engagement means, preferably an electromagnet 28 mounted on the fixed element 18 fiber secures the blade 16 to the support. The electromagnet 28 is energised and de-energised by a switch or other suitable means to permit the mounting and subsequent removal of the blade 16.

The support is mounted on the carriage 2 by suitable mounting means, for example a dowel 30 positioned underneath magnet 28 which fits into a hole 32 provided on the surface of the carriage 2. Alterative location holes 34 for the dowel 30 are also provided on the carriage 2. This permits the blade 16 to be ground from both sides of the grindstone 4 such that the cutting edge may be provided on the opposite faces of the blade 16 for blades which in use rotate in an anti-clockwise direction looking from above. The support may pivot about the dowel 30 if the cutting edge of the blade 16 is not to be ground parallel to the blade longitudinal axis. An adjustable and reversible side stop 36 is provided on the carriage to set the grinding angle of the blade 16.

During grinding, the traversing of blade 16 past the grindstone 4 is accomplished by movement of the carriage 2 in an axial direction along the slide 6. The carriage may be operated manually via a handle, or by an automatic reciprocating feed arrangement (not shown) meaning that the device can be operated entirely hands free. The amount of material ground away with each pass of the blade 16 past the grindstone 4 is controlled by the hand wheel 12. Adjustable limit stops (not shown) are fitted in both axial and transverse feed directions such that the grinding is limited to one half of the blade. When this is complete, the electromagnet is de-energised, the blade rotated 180° about the cone, and the electromagnet re-energised to hold the blade in order to grind the remaining half.

Although the device is shown in this embodiment having a single motor 5, two motors with respective grindstones may be used in place of the adjustable limit stops, thus negating the need for the blade 16, to be rotated. The position of the motors is individually adjustable to adjust the cutting depth, angle of cut, and account for wear of the grindstone.

The entire device is advantageously placed in a cabinet to ease its adjustment and operation, and to allow it to be portable. The cabinet preferably includes a hood portion with an extraction system to contain and collect the dust and sparks produced by the grinding process.

It will be understood that the device of the invention has been illustrated with reference to a Specific embodiment and that numerous modifications are possible within the scope of the invention.

What is claimed is:

1. A device for grinding a rotary mower blade which device comprises (i) an adjustable support having a fixed element and a slidable element; (ii) means for feeding the adjustable support and blade both axially and transversely relative to a grinding wheel and for pivoting the support towards and away from the grinding wheel; and (iii) a blade engagement element connected to the adjustable support for engaging the blade which adjustable support is adjusted to cause the blade to be moved about the blade engagement element at a substantially central point of the blade between a first grinding position for grinding one edge of the blade and a second grinding position so as to grind the opposite edge of the blade.

2. A device according to claim 1 wherein the adjustable support is mounted on a carriage for axial and transverse feeding.

3. A device according to claim 2 wherein the carriage is mounted on a slide extending perpendicular to the axis of the grindstone for transverse feed.

4. A device according to claim 3 wherein said transverse feed is controlled by means of a hand wheel attached by a feed screw to said carriage.

5. A device according to claim 2 wherein the carriage is mounted on a slide extending parallel to the axis of the grindstone for axial feed.

6. A device according to claim 5 wherein the axial feed is manually operated.

7. A device according to claim 5 wherein the axial feed is automatically operated.

8. A device according to claim 1 wherein the adjustable support pivots about an axis perpendicular to the axial and transverse feed directions.

9. A device according to claim 1 wherein the adjustable support pivots about an axis in line with the center of a fixing means mounted on said support.

10. A device according to claim 9 wherein the adjustable support pivots about a selected one of a plurality of available positions on the carriage.

11. A device according to claim 10 wherein the angle of pivot is set by an adjustable and reversible side stop.

12. A device according to claim 1 wherein the blade engagement element is a pivot.

13. A device as claimed in claim 1 wherein there further comprises fixing means for fixing the blade to the adjustable support which fixing means is spaced from the blade engagement element.

14. A device according to claim 13 wherein the pivot comprises a cone secured to the slidable element and the fixing means is a magnet secured to the fixed element.

15. A device according to claim 14 wherein the cone is adjusted to be positioned in a substantially central point of the blade.

16. A device according to claim 15 wherein the cone locates in an aperture in the center of the blade.

17. A device according to claim 1 in which the slidable element includes a longitudinal slot and the fixed element includes locking means slidable along said slot to adjust the support to a selected overall length.

18. A device as claimed in claim 13 wherein the fixing means comprises a magnet secured to the fixed element.

* * * * *